US012523120B2

(12) United States Patent
Ali et al.

(10) Patent No.: US 12,523,120 B2
(45) Date of Patent: Jan. 13, 2026

(54) PROCESSES AND APPARATUS FOR THE REMOVAL OF DEBRIS DURING DOWNHOLE OPERATIONS

(71) Applicant: Schlumberger Technology Corporation, Sugar Land, TX (US)

(72) Inventors: Ahmed Moge Ali, Dhahran (SA); Deo Dindial, Dhahran (SA); Hadrien Dumont, Paris (FR); Tariq Ahmed Mattar, Dhahran (SA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/572,237

(22) PCT Filed: Jun. 22, 2022

(86) PCT No.: PCT/US2022/034481

§ 371 (c)(1),
(2) Date: Dec. 20, 2023

(87) PCT Pub. No.: WO2022/271797

PCT Pub. Date: Dec. 29, 2022

(65) Prior Publication Data

US 2024/0295162 A1 Sep. 5, 2024

Related U.S. Application Data

(60) Provisional application No. 63/213,437, filed on Jun. 22, 2021.

(51) Int. Cl.
*E21B 37/06* (2006.01)
*E21B 49/08* (2006.01)

(52) U.S. Cl.
CPC ..... *E21B 37/06* (2013.01); *E21B 49/081* (2013.01)

(58) Field of Classification Search
CPC ..... E21B 37/08; E21B 49/10; E21B 48/08
See application file for complete search history.

(56) References Cited

U.S. PATENT DOCUMENTS 4,871,019 A 10/1989 Haley
5,323,800 A 6/1994 Vollweiler
(Continued)

FOREIGN PATENT DOCUMENTS

WO 2007125023 A1 11/2007
WO WO-2009052235 A1 * 4/2009 ..... E21B 49/10

OTHER PUBLICATIONS

International Search Report and Written Opinion issued in the PCT Application PCT/US2022/034481, dated Oct. 17, 2022 (10 pages).
(Continued)

*Primary Examiner* — Giovanna Wright
(74) *Attorney, Agent, or Firm* — Jeffrey D. Frantz

(57) ABSTRACT

Processes and apparatus for the removal of debris from conveyances and/or ports within a downhole fluid sampling apparatus. In some embodiments, the process can include providing a fluid sampling apparatus that includes a body that defines a volume. The process can also include starting at least one pump located within the volume. The process can also include conveying a quantity of a cleaning fluid stored within the volume by the pump through a fluid conveyance within the body and through a port of the body to an exterior of the body. The conveying of the quantity of the cleaning fluid can removes at least a portion of debris from at least one of the fluid conveyance and the port.

20 Claims, 4 Drawing Sheets

(56) References Cited

U.S. PATENT DOCUMENTS

| | | | | |
|---|---|---|---|---|
| 6,128,949 | A * | 10/2000 | Kleinberg | E21B 49/0875 73/61.79 |
| 2004/0045350 | A1 | 3/2004 | Jones | |
| 2004/0079527 | A1* | 4/2004 | Meister | E21B 49/10 73/152.43 |
| 2010/0132940 | A1* | 6/2010 | Proett | E21B 49/10 166/250.17 |
| 2010/0250142 | A1* | 9/2010 | Zamora | G01N 33/2823 702/12 |
| 2011/0139448 | A1* | 6/2011 | Ciglenec | E21B 49/10 166/264 |
| 2012/0267115 | A1 | 10/2012 | Brown | |
| 2015/0007631 | A1* | 1/2015 | Pelletier | E21B 49/10 73/1.02 |
| 2015/0053399 | A1* | 2/2015 | Irani | E21B 37/00 166/305.1 |
| 2016/0290102 | A1* | 10/2016 | Pelletier | G01N 33/004 |
| 2017/0175522 | A1* | 6/2017 | Smythe | E21B 49/08 |
| 2020/0379139 | A1* | 12/2020 | Hashem | E21B 49/0875 |
| 2021/0054737 | A1* | 2/2021 | Dai | E21B 49/081 |
| 2021/0238974 | A1* | 8/2021 | van Zuilekom | C09K 8/74 |
| 2021/0396098 | A1* | 12/2021 | Morrison | E21B 37/08 |

OTHER PUBLICATIONS

Extended Search Report issued in European Patent Application No. 22829212.4 dated Feb. 14, 2025, 6 pages.

* cited by examiner

PROCESSES AND APPARATUS FOR THE REMOVAL OF DEBRIS DURING DOWNHOLE OPERATIONS

CROSS-REFERENCE TO RELATED APPLICATIONS

This application is a National Stage of International Application No. PCT/US2022/034481, filed Jun. 22, 2022, which claims priority to U.S. Provisional Patent Application No. 63/213,437, filed on Jun. 22, 2021, which is incorporated by reference herein.

FIELD

Embodiments described generally relate to wireline operations for the hydrocarbon recovery industry. More particularly, such embodiments relate to processes and apparatus for the removal of debris, e.g., solids, that can impact filters, screens, and/or conveyances within a downhole fluid sampling apparatus that can hamper downhole operations.

BACKGROUND

As time proceeds, easy to access hydrocarbon deposits become more difficult to access. Drilling for these hydrocarbon deposits becomes more problematic as the deposits are generally deeper and more remote from the surface. Wireline operations for sampling of wells also becomes more problematic. In some wells, sampling of fluids to learn important features of the wellbore and reserves can be impacted by several factors. One factor in particular, for example, is the presence of mud and solids at the sampling apparatus. The solids may impede fluid flow into a sampling device, thereby preventing accurate analysis.

During typical downhole sampling operations, there is a tendency for formation and mud solids to plug the filters of focused probes, focused radial probes, dual packer inlets, and inlet filters along with flowlines of the sampling tools. In high mud solids content and at high percentages of low gravity solids in the mud, the probe inlet filter will build up debris and eventually plug. In some cases, this buildup cannot be cleared using traditional techniques, which results in a compromised sampling operation or incompletion of the program and not meeting the operational objectives.

There is a need, therefore, for improved processes and apparatus that are easier to operate than conventional apparatus and processes, where solids are not a concern for the sampling apparatus. There is a further need to provide processes and apparatus that do not have the drawbacks discussed above with solids plugging of sampling apparatus. There is a still further need to reduce economic costs associated with operations and apparatus for sampling with conventional tools.

SUMMARY

Processes and apparatus for the removal of debris from conveyances and/or ports within a downhole fluid sampling apparatus are provided. In some embodiments, the process can include providing a fluid sampling apparatus that can include a body that defines a volume. The process can also include starting at least one pump located within the volume. The process can also include conveying a quantity of a cleaning fluid stored within the volume by the pump through a fluid conveyance within the body and through a port of the body to an exterior of the body. The conveying of the quantity of the cleaning fluid can removes at least a portion of debris from at least one of the fluid conveyance and the port.

In other embodiments, the process can include providing a fluid sampling apparatus that can include a body that defines a volume. The process can also include pumping a cleaning fluid down to the fluid sampling apparatus. The process can also include starting a pump located within the volume. The process can also include conveying a quantity of a cleaning fluid through a fluid conveyance within the body and through a port of the body to an exterior of the body. The conveying of the quantity of the cleaning fluid can removes at least a portion of debris from at least one of the fluid conveyance and the port.

In some embodiments, the apparatus can include a body that can enclose an interior volume. The body can have at least one port. The apparatus can also include at least one pump disposed within the interior volume. The apparatus can also include at least one fluid reservoir disposed within the interior volume. The apparatus can also include an arrangement to sample fluid through the at least one port. The apparatus can also include at least one fluid conveyance that can connect the at least one pump and the at least one fluid reservoir. A cleaning fluid within the at least one reservoir can be configured to travel along the at least one fluid conveyance to an exterior of the body.

BRIEF DESCRIPTION OF THE DRAWINGS

So that the manner in which the above recited features of the present disclosure can be understood in detail, a more particular description of the disclosure, briefly summarized above, can be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments. It is contemplated that elements disclosed in one embodiment can be utilized in other embodiments without specific recitation.

DETAILED DESCRIPTION

Figure 1:
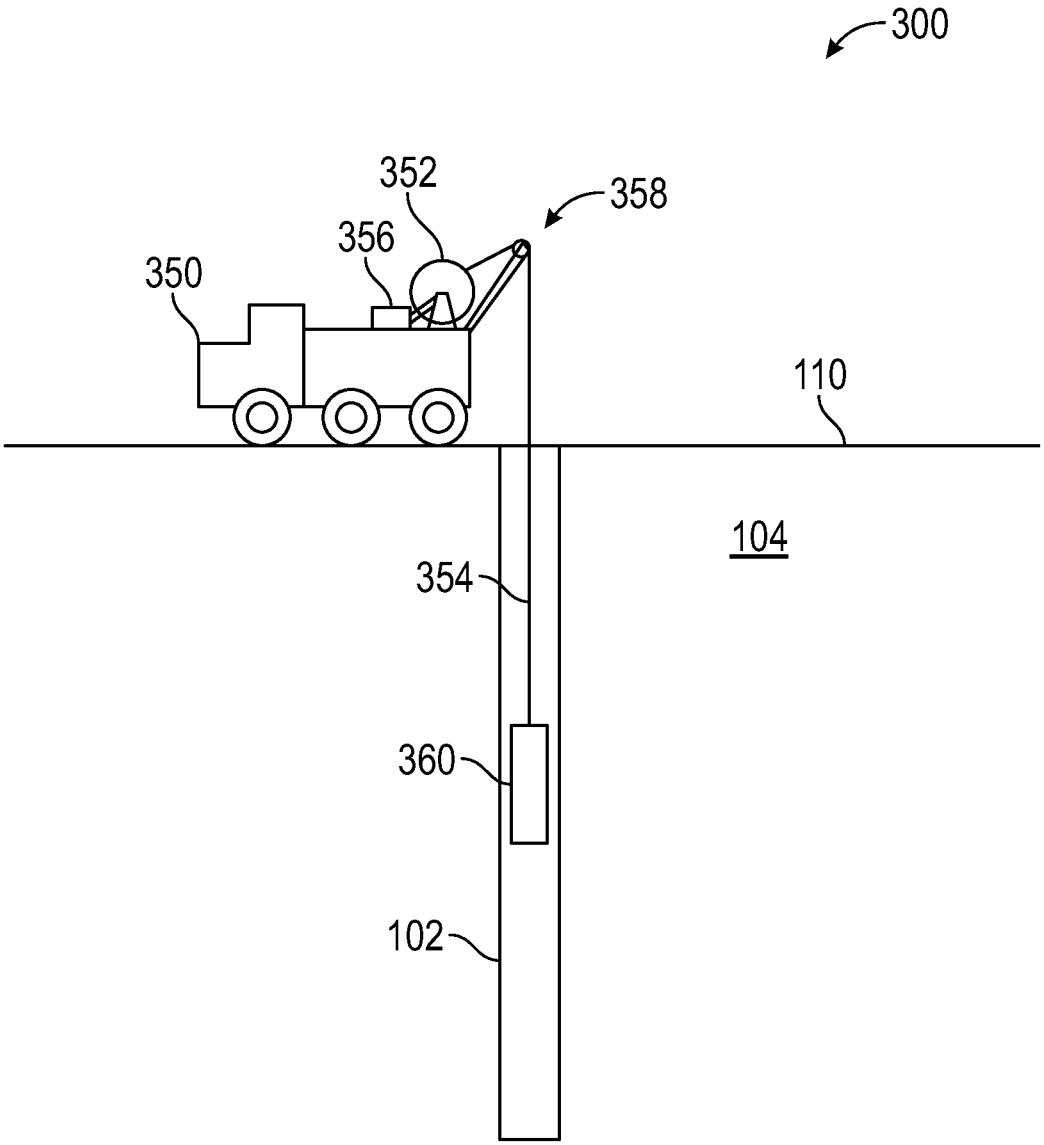
FIG. 1, depicts an illustrative wireline operation performed after a wellbore has been formed, according to one or more embodiments described.

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., can be used herein to describe various elements, components, regions, layers and/or sections, these elements, components, regions, layers and/or sections should not be limited by these terms. These terms can be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it can be directly on, engaged, connected, coupled to the other element or layer, or interleaving elements or layers can be present. In contrast, when an element is referred to as being "directly on," "directly engaged to," "directly connected to," or "directly coupled to" another element or layer, there can be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments can be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

FIG. 1, depicts an illustrative wireline operation 300 performed after a wellbore 102 has been formed, according to one or more embodiments. Wireline operations can be accomplished to obtain subsurface petrophysical and geophysical data related to the geological stratum 104 encountered by the wellbore 102. In these operations, a wireline truck 350 can be provided. The wireline truck 350 can be provided with a spool 352 that houses a cable 354. The cable 354 can be a single strand or multiple strand cable. The cable 354 can be configured to allow sensors and equipment to be lowered into the wellbore 102 such that the sensors and equipment may conduct required surveys. The lowering action can be accomplished by a motor 356 that can be connected to the spool 352. Within the wireline truck 350, an operator can activate and deactivate the motor 356 and control associated gearing to allow the spool 352 to unwind the cable at a desired rate. Sensors 358 can be provided to ascertain the amount of cable that has been unspooled to allow the operator to identify the location of equipment suspended by the cable 354.

Equipment supported by the cable 354 can include a single instrument package or multiple instrument packages. In the case of multiple instrument packages, such instrument packages can be modular such that different types of packages can be added together according to the needs of the operator. Different types of packages can include, but are not limited to, packer systems, pressure meter testing systems, nuclear measurement systems, optical spectrometry systems, pressure monitoring systems, resistivity calculation systems, sonic and ultrasonic tool systems, borehole seismic tool systems, nuclear magnetic resonance tool systems, pressure control systems, tractor and motion enhancement systems, power Generation systems, telemetry and Data recordation systems, and/or computing systems.

Generally, the different modular systems described above can be added together, as needed, to form a wireline apparatus 360 that can be called or known as a logging tool or sonde. The wireline apparatus 360 can be lowered into the wellbore 102 to a desired point in the geological stratum 104 and the appropriate system can be actuated. The wireline operator may take sensor readings at one point or may take multiple readings while changing the elevation of the wireline apparatus 360. The resulting string of measurements can be called a "log". Wireline operations can also be used in remediation of a wellbore 102 in order to increase production of hydrocarbons. Such operations, known as remediation or "workovers" may include augmenting existing wellbore 102 parameters.

In the instance of non-vertical wells, wireline operations can be augmented through the use of tractors that allow for the tools to reach more horizontal positions portions of a wellbore 102. Such horizontal portions of a wellbore 102 can be found, for example, in wells involving fracking operations where a "pay zone" is deposited horizontally parallel to the ground surface. To reach the near horizontal positions of such a wellbore 102, a tractor that grips the sides of the wellbore 102 can be used to convey instrument packages to the desired position in the wellbore 102.

Figure 2:
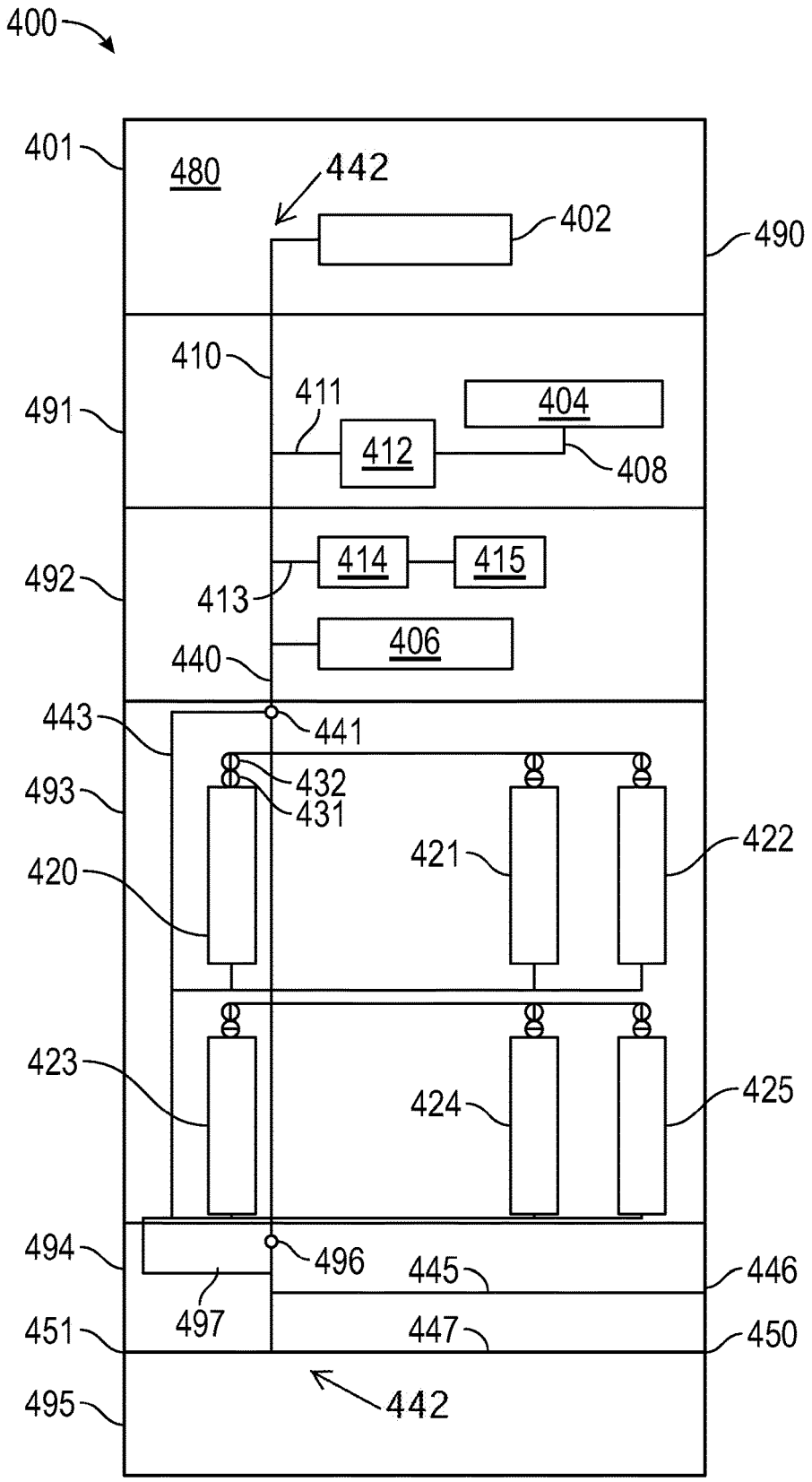
FIG. 2 depicts a cross-section of an illustrative fluid sampling apparatus, according to one or more embodiments described.

FIG. 2 depicts a cross-section of an illustrative sampling apparatus 400, according to one or more embodiments. The fluid sampling apparatus 400 can be configured to allow for sampling of fluids from the wellbore 102 environment. The fluid sampling apparatus 400 can be configured with a body 401 that can enclose or otherwise define an interior volume 480. As will be understood, sampling of fluids can occur at different elevations within the wellbore 102. In some instances, the sampling of fluids can be hampered by obstructions and/or buildup of debris within fluid conveyance lines and/or at ports or screens of the sampling apparatus 400. Conventional apparatus must be withdrawn from the wellbore 102 through action of the wireline truck 350 and consequently cleaned. The conventional apparatus is then reintroduced to the wellbore 102 and lowered to the desired elevation for analysis to begin. In wellbores 102 that have many solids in the fluid, the conventional apparatus can become re-contaminated and sampling can again be impacted. Often, engineers try to compensate for such obstructions by increasing a flow rate of pumps or, in other situations, just accept the lower flow rates of sampling.

The processes and apparatus disclosed herein can solve these problems by allowing for cleaning action to take place without removal of the fluid sampling apparatus 400 from the wellbore 102. Cleaning may take place at any place within the wellbore 102 allowing the operator freedom of operations for extended periods of time. With cleaning operations taking place within the wellbore 102, prolonged and repeated removal of the sampling apparatus 400 from a wellbore 102 is not necessary, saving significant time and associated economic costs. Another distinct advantage of the processes and apparatus described herein allow for the cleaning to occur at the specific point of sampling, thereby eliminating recontamination issues present when lowering the sampling device 400 to sampling depth levels.

In some embodiments, to accomplish cleaning activities, a reservoir or first reservoir of fluid 404 that contains a fluid therein can be maintained within the body of the sampling apparatus 400. In other embodiments, a fluid can be pumped down from an up-hole or surface location to the body of the sampling apparatus. For example, the sampling apparatus 400 can be located or otherwise placed within a downhole environment via a coiled tubing, drill pipe, or other conveyance device capable of transferring the fluid from the up-hole or surface location to the tool. In some embodiments, the cable 354 (FIG. 1) can include a flow path configured to transfer the fluid from the up-hole or surface location to the sampling apparatus 400. In other embodiments, the fluid can be pumped down from a separate portion or section of wireline apparatus 360. For simplicity and ease of description, the fluid will be further discussed and described with regard to being contained within the fluid reservoir 404, but it should be understood that the fluid can instead be conveyed to the sampling apparatus 400 from an up-hole location such as the surface or a separate section of the wireline apparatus 360.

In some embodiments, the fluid in the reservoir of fluid 404 can dissolve, react with, reduce the viscosity of, break down, or otherwise affect debris, e.g., solids or semi-solid material, that can be deposited within at least a portion of a system of conveyances 442, e.g., filters, screens, flow lines, ports, etc., such that the debris can be removed therefrom with the fluid. In other embodiments, the fluid 404 can interact with the debris deposited within the system of conveyances 442 with sufficient force to cause the deposited debris to dissipate or otherwise be loosened and removed therefrom. Accordingly, the fluid in the in the reservoir of fluid 404 can also be referred to as a cleaning fluid.

The composition of the fluid in the reservoir of fluid 404 can be based, at least in part, on the expected type of debris that may potentially deposit within at least a portion of the system of conveyances 442. In some embodiments, the debris can be or can be derived from a drilling mud, e.g., solids in the drilling mud, formation fluid, or other materials that can be found in or introduced into a wellbore. In some embodiments, a demineralized water can be used as the fluid in the reservoir of fluid 404. In other embodiments, an acidic fluid can be used as the fluid in the reservoir of fluid 404. In some embodiments, the acid can be or can include, but is not limited to, hydrochloric acid, sulfuric acid, hydrofluoric acid, nitric acid, citric acid, glyceric acid, acetic acid, oxalic acid, gluconic acid, glycolic acid, levulinic acid, formic acid, or a mixture thereof. In still further embodiments, a caustic fluid can be used as the fluid in the reservoir of fluid 404. In some embodiments, the caustic can be or can include, but is not limited to, sodium hydroxide, sodium carbonate, potassium hydroxide, potassium carbonate, calcium hydroxide, or a mixture thereof. In other embodiments, a gas, e.g., nitrogen, carbon dioxide, argon, oxygen, or any mixture thereof can be used as the fluid in the reservoir of fluid 404. In some embodiments, the fluid in the reservoir of fluid 404 can be or can include one or more surfactants, wetting agents, emulsifiers, saponifiers, chelating agents, solvents, soaps, detergents, or a mixture thereof.

In some embodiments, the reservoir of fluid 404 can be under pressure such that upon actuation of a valve 412, fluid can exit the reservoir of fluid 404. In other embodiments, the reservoir of fluid 404 can include a moveable piston that upon actuation of the valve 412 and the piston, fluid can exit the reservoir of fluid 404. In such embodiment, the piston can be hydraulically, pneumatically, or electrically actuated. In other embodiments, upon actuation of the valve 412, a pump or first pump 402 can be used to provide motive force for the fluid traveling through at least a portion of the system of conveyances 442 of the sampling apparatus 400. For example, a conveyance 410 can fluidly connect the first pump 402 and the reservoir of fluid 404. The pump 402 can be provided electricity for operation through a downhole battery system connected to the pump 402. In other embodiments, a turbine can be used to generate electrical energy to operate the pump 402. In other embodiments, the cable 354 (FIG. 1) can provide electricity to operate the pump 402. A series of valves can be positioned such that fluid can be directed into a portion (or all) of the system of conveyances 442 of the sampling apparatus 400 that can be desired to be cleared of debris. The series of valves can be electrically connected to control systems that allow the operator to switch exit paths and/or travel paths for the fluid from the reservoir of fluid 404 to travel.

In other embodiments, more than one pump can be used to provide the motive force for the fluid. The inclusion of a second pump 406 can provide for redundancy of the pumping capability, thereby providing a more fail proof design. Additionally, if greater pressure is desired to be used, both pumps 402 and 406 can be used in combination, thereby allowing for greater ejection force of the fluid. Connections to the second pump 406 can be controlled, in a similar fashion, to that of the first pump 402.

In some embodiments, a configuration of bottles 420, 421, 422, 423, 424, 425 can be present within one portion of the sampling apparatus. In some embodiments, the configuration of bottles 420, 421, 422, 423, 424, 425 can provide for acceptance of fluid from the reservoir of fluid 404 to be retained. In other embodiments, upon actuation of specific valves connected with an individual bottle, the bottle can be open to a fluid pathway, allowing the fluid from the reservoir of fluid 404 to travel along the pathway dislodging/removing materials along the fluid pathway. In the illustrated embodiment, six bottles 420, 421, 422, 423, 424, 425 are present which can be supplied with a capability to sample fluid from outside the body 401 of the fluid sampling apparatus 400. As will be understood, at the initiation of a project, the bottles 420, 421, 422, 423, 424, 425 can be empty and the reservoir of fluid 404 can be charged with fluid, thereby providing an ability to both sample fluids from outside the body 401 of the fluid sampling apparatus 400 when a pump creates a draw on at least one port such as port 446, 450, and/or 451 of the body 401, as well as multiple "shots" of fluid to be ejected from the sampling apparatus 400 to clean at least a portion of the system of conveyances 442 and/or ports 446, 450, and/or 451.

As will be appreciated, one skilled in the art will readily recognize that one or more valves can be opened and/or closed to direct a sample of fluid from outside the body 401 and into to a desired bottle. Likewise, one or more valves can be opened and/or closed to direct fluid from the reservoir of fluid 404 through a selected flow path through the system of conveyances 442 and out of the body via port 446, 450, and/or 451. In some embodiments, rather than flowing the fluid from the reservoir of fluid 404 one or more of the ports 446, 450, 451 the fluid from the reservoir of fluid can be directed into one or more of the bottles 420, 421, 422, 423, 424, 425.

In the illustrated embodiment, the first pump 402 can be located within a first section 490 of the fluid sampling apparatus 400. A second section 491 of the fluid sampling apparatus 400 can house the fluid reservoir 404. A conveyance 411 with an associated valve 412 can be provided such that a draw of the fluid can occur when the first pump 402 and/or a second pump 406 is actuated. The second pump 406 can be located in a third section 492 of the fluid sampling apparatus 400. The second pump 406 can be used to draw fluid from the fluid reservoir 404. For example, a conveyance 440 can be in fluid communication with the second pump 406 to channel fluid through at least a portion of the system of conveyances 442 to piping associated with a first bottle 420, a second bottle 421, a third bottle 422, a fourth bottle 423, a fifth bottle 424, and/or a sixth bottle 425 located in a fourth section 493 of the fluid sampling apparatus 400. In some embodiments, an outlet valve can also be positioned along the system of conveyances 442 to allow the bottles 420, 421, 422, 423, 424, 425 to be closed from downstream portions of the fluid sampling apparatus 400. In some embodiments, one or more of the bottles 420, 421, 422, 423, 424, 425 can be temperature controlled. A fifth section 494 of the fluid sampling apparatus 400 can include an outlet or port 446 that can be used for sampling fluid from outside the body 401 of the fluid sampling apparatus 400. As such, fluid traveling from the system of conveyance 442 can exit one or more of the outlet or port 446, 450, 451.

In some embodiments, the fluid sampling apparatus 400 can also include a reservoir or second reservoir of fluid 415 that can contain a second fluid, e.g., a neutralizing agent. A conveyance 413 with an associated valve 414 can be provided such that a draw of the second fluid from the second reservoir of fluid 415 can occur when the first pump 402 and/or the second pump 406 is actuated. In other embodiments, the second fluid can be a component of the fluid contained within the first reservoir of fluid 404. In some embodiments, the second fluid can be carried through the various portions of the fluid sampling apparatus 400 after the fluid from the first reservoir of fluid 404 has been used to remove debris deposited within the system of conveyances 442 and/or one or more of the sample bottles 420, 421, 422, 423, 424, 425 to reduce the effects of the solution on flowline components. In other embodiments, the second fluid can flow through at least a portion of the system of conveyances 442 and/or into and/or through one or more of the sample bottles 420, 421, 422, 423, 424, 425 alone and/or before the fluid from the first reservoir of fluid 404.

In some embodiments, the fluid in the reservoir of fluid 404 and/or the second fluid in the reservoir of fluid 415 can be heated to an elevated temperature relative to the ambient temperature within the wellbore 102 (FIG. 1). As such, in some embodiments the fluid sampling apparatus 400 can include a heater configured to actively heat the fluid within the reservoir of fluid 404 and/or 415. In other embodiments, the fluid in the reservoir of fluid 404 and/or the second fluid in the reservoir of fluid 415 can be cooled relative to the ambient temperature within the wellbore 102. As such, in some embodiments, the fluid sampling apparatus 400 can include a refrigeration device configured to actively cool the fluid within the reservoir of fluid 404 and/or 415. In still other embodiments, the fluid in the reservoir of fluid 404 and/or the second fluid in the reservoir of fluid 415 can be substantially the same temperature as the ambient temperature within the wellbore 102.

In some embodiments, a sixth section 495 of the fluid sampling apparatus 400 can include two or more conveyance portions through which the cleaning fluid can be conveyed, while further sections (not shown) of the fluid sampling apparatus 400 can include additional conveyances that can be cleaned. As shown, the sixth section 495 can include conveyance portion 445 that can be in fluid communication with the outlet or port 446 and conveyance portion 447 that can be in fluid communication with the outlets or ports 450, 451. As such, in some embodiments, the fluid sampling apparatus 400 can include at least three outlets or ports 446, 450, 451.

As illustrated, different valving can be present within the various sections of the fluid sampling apparatus 400 to allow the fluid to be channeled through or stopped according to the needs of the operator. Any number of valves can be positioned along the conveyances 410, 411, 413, 440, 445, 447, and/or the conveyances connecting the sample bottles 420, 421, 422, 423, 424, 425 to the system of conveyances 442. In some embodiments, a valve 441 can be located along conveyance 440 that can be configured to direct fluid from the first and/or second reservoir of fluid 404, 415 into conveyance 443. As shown, valves 431, 432 can be opened and fluid can flow through conveyance 443, into sample bottle 420, and out of sample bottle 420 and back into conveyance 440, where the fluid can then flow through open valve 496, into conveyance 445 and/or conveyance 447 and out one or more of the ports 446, 450, 451. As shown, valves associated with the other sample bottles 421, 422, 423, 424, 425 can be closed such that the fluid does not flow into those bottles. In other embodiments, any one or more of the sample bottles 420, 421, 422, 423, 424, 425 can be configured to receive fluid and/or to remain isolated from receiving fluid. It should be understood that one or more valves can be located between the end of the sample bottles 420, 421, 422, 423, 424, 425 and the conveyance 443 so that the sample bottles 420, 421, 422, 423, 424, 425 can be selectively placed into fluid communication with conveyance 443 and/or remain fluidly isolated from conveyance 443. In some embodiments, when the valve 441 is configured to direct fluid from the reservoir of fluid 404 and/or 415 and all the sample bottles 420, 421, 422, 423, 424, 425 are fluidly isolated, a conveyance 497 can be configured direct the fluid from conveyance 443 into conveyance 445 and/or conveyance 447. In such embodiment, valve 496 can be configured to prevent the fluid from flowing into the portion of the conveyance 440 located between valves 441 and 496.

In some embodiments, all the sample bottles 420, 421, 422, 423, 424, 425 can be fluidly isolated from the system of conveyances 442 and the fluid from the first and/or second reservoir of fluid 404, 415 can flow through all or a selected portion of the system of conveyances 442 and out one or more of the ports 446, 450, 451. In some embodiments, valves can be used to isolate conveyance portion 445, conveyance portion 447, and/or one or more of the ports 446, 450, 451 from the exterior of the fluid sampling apparatus 400 and/or the rest of the system of conveyances 442. The valves can be controlled at the discretion of the operator to allow needed cleaning within discrete sections of the fluid sampling apparatus 400.

In some embodiments, the fluid in the first reservoir of fluid 404 can be or can include an acid and the fluid in the second reservoir of fluid 415 can be or can include a caustic. In other embodiments, the fluid in the first reservoir of fluid 404 can be or can include a caustic and the fluid in the second reservoir of fluid 415 can be or can include an acid. Depending on the particular composition of the fluid in the first reservoir of fluid 404, the composition of the fluid in the second reservoir of fluid 415 can be readily adjusted so that at least a portion of any potential negative impacts that can be caused by the fluid from the first reservoir of fluid 404 as the fluid travels through at least a portion of the system of conveyance 442 can be reduced or otherwise mitigated.

Figure 3:
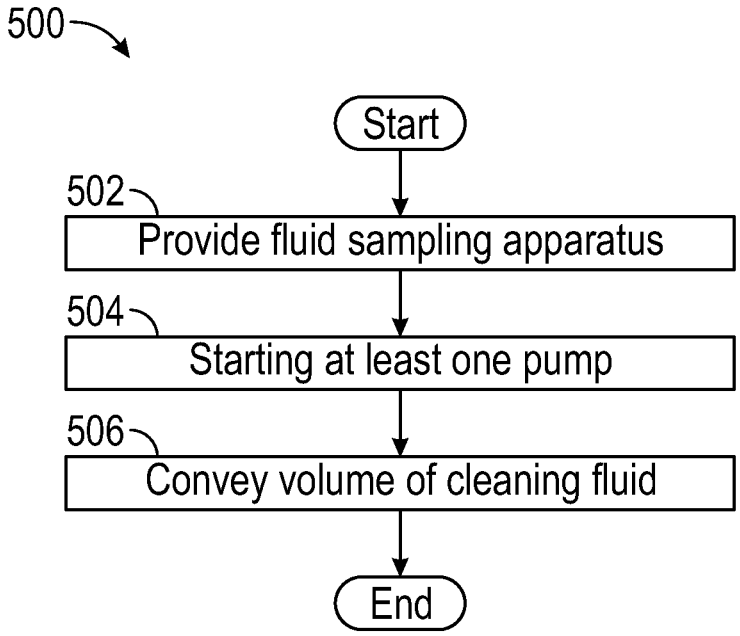
FIG. 3 depicts an illustrative process for cleaning a fluid sampling apparatus according to one or more embodiments described.

FIG. 3 depicts an illustrative process 500 for cleaning a fluid sampling apparatus according to one or more embodiments. The process 500 can include, at 502, providing a fluid sampling apparatus that includes a body that encloses or otherwise defines a volume. The process 500 can further include, at 504, starting at least one pump located within the volume. The process 500 can include, at 506, conveying a volume of a cleaning fluid stored within the volume by the pump to at least one port of the body via one or more conveyances within the body, where conveying the volume of the cleaning fluid can dislodge debris from the one or more conveyances and/or the at least one port.

Figure 4:
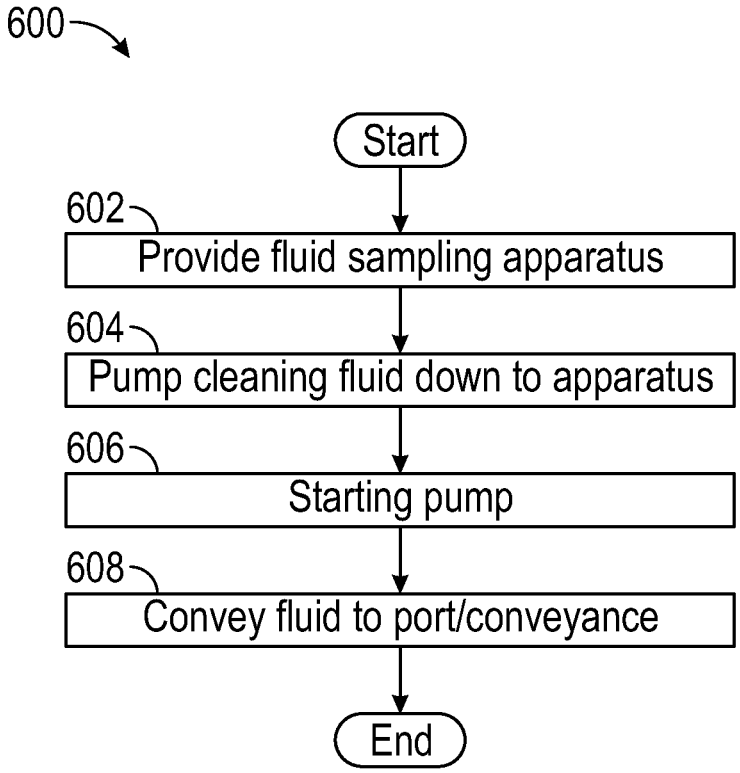
FIG. 4 depicts another illustrative process for cleaning a fluid sampling apparatus, according to one or more embodiments described.

FIG. 4 depicts another illustrative process 600 for cleaning a fluid sampling apparatus, according to one or more embodiments. The process 600 can include, at 602 providing a fluid sampling apparatus with a body that encloses or otherwise defines a volume. The process 600 can also include, at 604, pumping a cleaning fluid down to the fluid sampling apparatus. The process 600, can also include, at 606 starting a pump located within the volume. The process 600, can also include, at 608, conveying a volume of a cleaning fluid to at least one port of the body via one or more conveyances within the body. Conveying the volume of the cleaning fluid can dislodge debris from the one or more conveyances and/or the at least one port. As will be understood, the process in FIG. 6 entails providing the fluid from a source located above the fluid sampling device rather than from within the fluid sampling device. Such sources can be at a surface of the earth or can include tanks located on the wireline apparatus 360.

Aspects of the disclosure also provide processes that can be performed to achieve a stated goal, including controlling components described in the specification. In some embodiments, the processes described can be performed by circuits and/or computers that are configured to perform such tasks.

Figure 5:
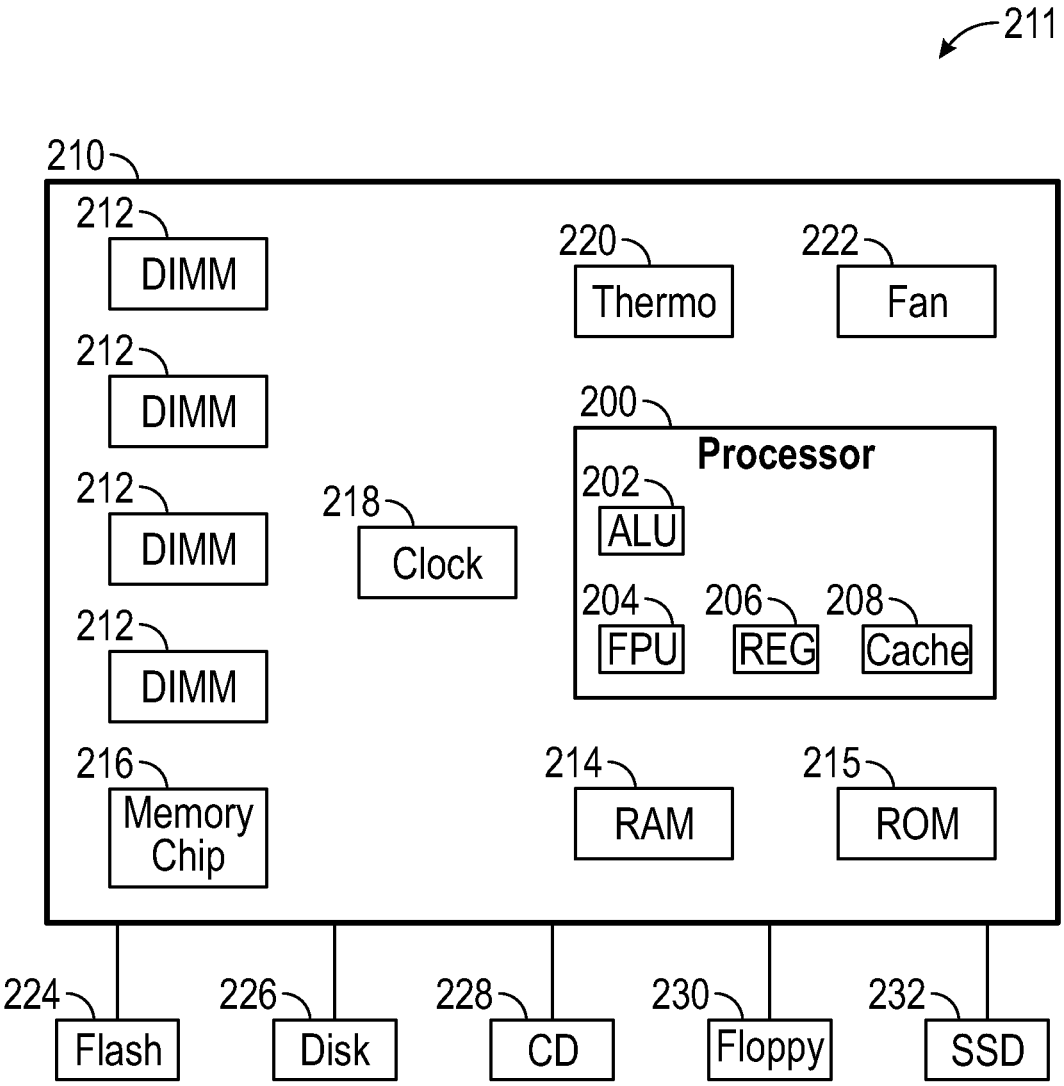
FIG. 5 depicts an illustrative computing apparatus that can be used in the control of the apparatus and processes of FIGS. 1-4.

FIG. 5 depicts an illustrative computing apparatus that can be used in the control of equipment of FIGS. 1 and 2. In FIG. 5, a processor 200 is provided to perform computational analysis for instructions provided. The instruction provided, code, can be written to achieve the desired goal and the processor may access the instructions. In other embodiments, the instructions can be provided directly to the processor 200.

In other embodiments, other components can be substituted for generalized processors. These specifically designed components, known as application specific integrated circuits ("ASICs") are specially designed to perform the desired task. As such, the ASICs generally have a smaller footprint than generalized computer processors. The ASICs, when used in embodiments of the disclosure, may use field programmable gate array technology, that allows a user to make variations in computing, as necessary. Thus, the processes described herein are not specifically held to a precise embodiment, rather alterations of the programming can be achieved through these configurations.

In some embodiments, when equipped with a processor 200, the processor 200 may have arithmetic logic unit ("ALU") 202, a floating point unit ("FPU") 204, registers 206 and a single or multiple layer cache 208. The arithmetic logic unit 202 may perform arithmetic functions as well as logic functions. The floating point unit 204 can be a math coprocessor or numeric coprocessor to manipulate number for efficiently and quickly than other types of circuits. The registers 206 can be configured to store data that will be used by the processor during calculations and supply operands to the arithmetic unit and store the result of operations. The single or multiple layer caches 208 can be provided as a storehouse for data to help in calculation speed by preventing the processor 200 from continually accessing random access memory ("RAM").

In some embodiments, aspects of the disclosure provide for the use of a single processor 200. Other embodiments of the disclosure allow the use of more than a single processor 200. Such configurations can be called a multi-core processor where different functions can be conducted by different processors 200 to aid in calculation speed. In embodiments, when different processors 200 are used, calculations can be performed simultaneously by different processors 200, a process known as parallel processing.

The processor 200 can be located on a motherboard 210. The motherboard 210 is a printed circuit board that incorporates the processor 200 as well as other components helpful in processing, such as memory modules ("DIMMS") 212, random access memory 214, read only memory 215, non-volatile memory chips 216, a clock generator 218 that keeps components in synchronization, as well as connectors for connecting other components to the motherboard 210. The motherboard 210 may have different sizes according to the needs of the computer architect. To this end, the different sizes, known as form factors, may vary from sizes from a cellular telephone size to a desktop personal computer size. The motherboard 210 may also provide other services to aid in functioning of the processor 200, such as cooling capacity. Cooling capacity may include a thermometer 220 and a temperature controlled fan 222 that conveys cooling air over the motherboard 210 to reduce temperature.

Data stored for execution by the processor 200 can be stored in several locations, including the random access memory 214, read only memory 215, flash memory 224, computer hard disk drives 226, compact disks 228, floppy disks 230 and solid state drives 232. For booting purposes, data can be stored in an integrated chip called an EEPROM, that is accessed during start-up of the processor 200. The data, known as a Basic Input/Output System ("BIOS"), contains, in some example embodiments, an operating system that controls both internal and peripheral components.

Different components can be added to the motherboard 210 or can be connected to the motherboard 210 to enhance processing. Examples of such connections of peripheral components can be video input/output sockets, storage configurations (such as hard disks, solid state disks, or access to cloud based storage), printer communication ports, enhanced video processors, additional random access memory and network cards.

The processor 200 and motherboard 210 can be provided in a discrete form factor, such as personal computer, cellular telephone, tablet, personal digital assistant or other component. The processor 200 and motherboard 210 can be connected to other such similar computing arrangement in networked form. Data can be exchanged between different sections of the network to enhance desired outputs. The network can be a public computing network or can be a secured network where only authorized users or devices can be allowed access.

As will be understood, process steps for completion can be stored in the random access memory 214, read only memory 215, flash memory 224, computer hard disk drives 226, compact disks 228, floppy disks 230 and solid state drives 232.

Different input/output devices can be used in conjunction with the motherboard 210 and processor 200. Input of data can be through a keyboard, voice, Universal Serial Bus ("USB") device, mouse, pen, stylus, Firewire, video camera, light pen, joystick, trackball, scanner, bar code reader and touch screen. Output devices may include monitors, printers, headphones, plotters, televisions, speakers and projectors.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same can be varied in many ways. Such variations are not to be regarded as a departure from the disclosure, and all such modifications are intended to be included within the scope of the disclosure.

The present disclosure further relates to any one or more of the following numbered paragraphs.

1. A process, comprising: providing a fluid sampling apparatus comprising a body that defines a volume; starting at least one pump located within the volume; and conveying a quantity of a cleaning fluid stored within the volume by the pump through a fluid conveyance within the body and through a port of the body to an exterior of the body, wherein the conveying of the quantity of the cleaning fluid removes at least a portion of a debris from at least one of the fluid conveyance and the port.
2. The process according to paragraph 1, wherein the debris is deposited within the conveyance and/or the port during a downhole fluid sampling operation.
3. The process according to paragraph 1 or 2, wherein at least one valve isolating the cleaning fluid from the fluid conveyance is opened before, after, or when the at least one pump is started.
4. The process according to any one of paragraphs 1 to 3, wherein the cleaning fluid is a gas, a liquid, or a combination thereof.
5. The process according to any one of paragraphs 1 to 4, wherein the cleaning fluid comprises demineralized water, an acid, a caustic, or a mixture thereof.
6. The process according to any one of paragraphs 1 to 5, wherein the fluid sampling apparatus is located within a wellbore.
7. The process according to any one of paragraphs 1 to 6, further comprising: after conveying the quantity of the cleaning fluid, using the at least one pump or using at least one second pump located within the volume to convey a quantity of a neutralizing agent through at least a portion of the fluid conveyance within the body and through the port of the body to an exterior of the body to reduce an effect of the cleaning fluid on the fluid conveyance.
8. The process according to paragraph 7, wherein the cleaning fluid comprises an acid and the neutralizing agent comprises a caustic, or wherein the cleaning fluid comprises a caustic and the neutralizing agent comprises an acid.
9. The process according to paragraph 7 or 8, wherein at least one of the cleaning fluid and the neutralizing agent is heated to an elevated temperature relative to an ambient temperature within the wellbore.
10. The process according to paragraph 7 or 8, wherein at least one of the cleaning fluid and the neutralizing agent is cooled relative to an ambient temperature within the wellbore.
11. A process, comprising: providing a fluid sampling apparatus comprising a body that defines a volume; pumping a cleaning fluid down to the fluid sampling apparatus; starting a pump located within the volume; and conveying a quantity of a cleaning fluid through a fluid conveyance within the body and through a port of the body to an exterior of the body, wherein the conveying of the quantity of the cleaning fluid removes at least a portion of debris from at least one of the fluid conveyance and the port.
12. The process according to paragraph 11, wherein the debris is deposited within the conveyance and/or the port during a downhole fluid sampling operation.
13. The process according to paragraph 11 or 12, wherein the cleaning fluid is a gas, a liquid, or a combination thereof.
14. The process according to any one of paragraphs 11 to 13, wherein the cleaning fluid comprises demineralized water an acid, a caustic, or a mixture thereof.
15. The process according to any one of paragraphs 11 to 14, wherein the fluid sampling apparatus is located within a wellbore.
16. The process according to any one of paragraphs 11 to 15, further comprising: pumping a neutralizing agent down to the fluid sampling apparatus; and after conveying the quantity of the cleaning fluid, using the pump or using at least one second pump located within the volume to convey a quantity of the neutralizing agent through at least a portion of the fluid conveyance within the body and through the port of the body to an exterior of the body to reduce an effect of the cleaning fluid on the fluid conveyance.
17. The process according to paragraph 16, wherein the cleaning fluid comprises an acid and the neutralizing agent comprises a caustic, or wherein the cleaning fluid comprises a caustic and the neutralizing agent comprises an acid.
18. The process according to paragraph 16 or 17, wherein at least one of the cleaning fluid and the neutralizing agent is heated to an elevated temperature relative to an ambient temperature within the wellbore.
19. The process according to paragraph 16 or 17, wherein at least one of the cleaning fluid and the neutralizing agent is cooled relative to an ambient temperature within the wellbore.
20. An apparatus, comprising: a body enclosing an interior volume, the body having at least one port; at least one pump disposed within the interior volume; at least one fluid reservoir disposed within the interior volume; an arrangement to sample fluid through the at least one port; and at least one fluid conveyance connecting the at least one pump and the at least one fluid reservoir, wherein a cleaning fluid within the at least one reservoir is configured to travel along the at least one fluid conveyance to an exterior of the body.
21. The apparatus according to paragraph 20, wherein the at least one pump comprises a first pump and a second pump, wherein the at least one fluid conveyance connects the first and second pumps and the at least one fluid reservoir.

22. The apparatus according to paragraph 21, wherein the first pump, the second pump, or both the first and second pump is configured to provide a motive force for the cleaning fluid to travel along the at least one fluid conveyance to the exterior of the body.
23. The apparatus according to any one of paragraphs 20 to 22, wherein the arrangement to sample fluid comprises: at least one bottle configured to store a portion of a downhole fluid obtained from an exterior of the body within the at least one bottle; and at least one valve connecting the at least one bottle to the at least one conveyance.
24. The apparatus according to paragraph 23, wherein the at least one bottle comprises six bottles, and wherein each of the six bottles is connected by at least one valve to the at least one conveyance.
25. The apparatus according to paragraph 24, wherein each bottle is temperature controlled.
26. The apparatus according to any one of paragraphs 20 to 25, wherein the body has at least three ports.
27. The apparatus according to any one of paragraphs 20 to 26, wherein the at least one fluid reservoir comprises a first fluid reservoir configured to contain the cleaning fluid and a second fluid reservoir configured to contain a neutralizing agent, wherein the cleaning fluid within the first fluid reservoir is configured to travel along the at least one fluid conveyance to an exterior of the body to remove at least a portion of debris deposited therein, and wherein the neutralizing agent within the second fluid reservoir is configured to travel along at least a portion of the at least one fluid conveyance to the exterior of the body to reduce an effect of the cleaning fluid on the fluid conveyance.
28. The apparatus according to paragraph 27, wherein at least one of the first fluid reservoir and the second fluid reservoir is configured to actively heat a fluid therein to a temperature above an ambient temperature within a wellbore when the apparatus is located within the wellbore.
29. The apparatus according to paragraph 27, wherein at least one of the first fluid reservoir and the second fluid reservoir is configured to actively cool a fluid therein to a temperature below an ambient temperature within a wellbore when the apparatus is located within the wellbore.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A process, comprising:

providing a fluid sampling apparatus comprising a body that defines a volume, wherein the volume comprises a plurality of fluid reservoirs storing one or more cleaning fluids in the fluid sampling apparatus;

starting at least one pump located within the volume;

conveying a quantity of a cleaning fluid stored within the volume by the pump through a fluid conveyance within the body and through at least one port of three ports of the body to an exterior of the body, wherein the conveying of the quantity of the cleaning fluid breaks down or dissolves and further removes at least a portion of solid debris causing a plug at a probe inlet filter disposed inside at least one of the fluid conveyance or the at least one port, and wherein the three ports are each configured to draw a sample fluid into the fluid sampling apparatus and eject the sample fluid or the cleaning fluid; and adjusting a fluid composition of the cleaning fluid in the fluid sampling apparatus at least by opening a first valve coupled to a first fluid reservoir of the plurality of fluid reservoirs, opening a second valve coupled to a second fluid reservoir of the plurality of fluid reservoirs, or both, and wherein the fluid composition of the cleaning fluid is based on a composition of the solid debris.

2. The process according to claim 1, wherein at least one valve isolating the cleaning fluid from the fluid conveyance is opened before, after, or when the at least one pump is started.

3. The process according to claim 1, wherein the first and second fluid reservoirs store different cleaning fluids, and each of the first and second fluid reservoirs comprises one of a demineralized water reservoir, an acid reservoir, or a caustic reservoir.

4. The process according to claim 1, further comprising:

after conveying the quantity of the cleaning fluid, using the at least one pump or using at least one second pump located within the volume to convey a quantity of a neutralizing agent through at least a portion of the fluid conveyance within the body and through the at least one port of the body to an exterior of the body to reduce an effect of the cleaning fluid on the fluid conveyance.

5. The process of claim 4, wherein the cleaning fluid comprises an acid and the neutralizing agent comprises a caustic, or wherein the cleaning fluid comprises a caustic and the neutralizing agent comprises an acid.

6. The process according to claim 1, wherein the probe inlet filter includes multiple filters.

7. The process of claim 1, wherein the one or more cleaning fluids comprise nitrogen, argon, oxygen, or any combination thereof.

8. A process, comprising:

providing a fluid sampling apparatus comprising a body that defines a volume, wherein the volume comprises a plurality of fluid reservoirs storing one or more cleaning fluids in the fluid sampling apparatus;

starting a pump located within the volume;

conveying a quantity of a cleaning fluid through a fluid conveyance within the body and through at least one port of three ports of the body to an exterior of the body, wherein the conveying of the quantity of the cleaning fluid breaks down or dissolves and further removes at least a portion of solid debris causing a plug at a probe inlet filter disposed inside at least one of the fluid conveyance or the at least one port, and wherein the three ports are each configured to draw a sample fluid into the fluid sampling apparatus and eject the sample fluid or eject the cleaning fluid; and adjusting a fluid composition of the cleaning fluid in the fluid sampling apparatus at least by opening a first valve coupled to a first fluid reservoir of the plurality of fluid reservoirs, opening a second valve coupled to a second fluid reservoir of the plurality of fluid reservoirs, or both, and wherein the fluid composition of the cleaning fluid is based on a composition of the solid debris.

9. The process according to claim 8, wherein the cleaning fluid comprises demineralized water, an acid, a caustic, or a mixture thereof.

10. The process according to claim 8, further comprising:

pumping the one or more cleaning fluids down to the fluid sampling apparatus;

pumping a neutralizing agent down to the fluid sampling apparatus; and after conveying the quantity of the cleaning fluid, using the pump or using at least one second pump located within the volume to convey a quantity of the neutralizing agent through at least a portion of the fluid conveyance within the body and through the at least one port of the body to an exterior of the body to reduce an effect of the cleaning fluid on the fluid conveyance.

11. The process of claim 10, wherein the cleaning fluid comprises an acid and the neutralizing agent comprises a caustic, or wherein the cleaning fluid comprises a caustic and the neutralizing agent comprises an acid.

12. The process of claim 8, wherein the one or more cleaning fluids comprise one or more surfactants, wetting agents, saponifiers, chelating agents, solvents, soaps, detergents, or any combination thereof.

13. An apparatus with cleaning capabilities inside a wellbore, comprising:

a body enclosing an interior volume, the body having three ports, wherein the three ports are each configured to draw a sample fluid into the apparatus and eject the sample fluid or eject a cleaning fluid;

at least one pump disposed within the interior volume;

a plurality of fluid reservoirs storing one or more cleaning fluids within the interior volume, wherein, in operation, the apparatus adjusts a fluid composition of the cleaning fluid by opening a first valve coupled to a first fluid reservoir of the plurality of fluid reservoirs, opening a second valve coupled to a second fluid reservoir of the plurality of fluid reservoirs, or both;

an arrangement to draw the sample fluid through at least one port of the three ports; and at least one fluid conveyance connecting the at least one pump and the plurality of fluid reservoirs, wherein, in operation of the apparatus, the cleaning fluid travels along the at least one fluid conveyance to an exterior of the body, the cleaning fluid breaks down or dissolves and further removes a plug of solids debris at a probe inlet filter disposed inside the at least one fluid conveyance or the at least one port, and the fluid composition of the cleaning fluid is based on a composition of the solid debris.

14. The apparatus according to claim 13, wherein the at least one pump comprises a first pump and a second pump, wherein the at least one fluid conveyance connects the first and second pumps and the plurality of fluid reservoirs.

15. The apparatus according to claim 13, wherein the arrangement to draw the sample fluid comprises:

at least one bottle configured to store a portion of a downhole fluid obtained from an exterior of the body within the at least one bottle; and at least one valve connecting the at least one bottle to the at least one conveyance.

16. The apparatus according to claim 13, wherein the plurality of fluid reservoirs comprises a first fluid reservoir configured to contain the cleaning fluid and a second fluid reservoir configured to contain a neutralizing agent, wherein the cleaning fluid within the first fluid reservoir is configured to travel along the at least one fluid conveyance to an exterior of the body to remove at least a portion of solid debris deposited therein, and wherein the neutralizing agent within the second fluid reservoir is configured to travel along at least a portion of the at least one fluid conveyance to the exterior of the body to reduce an effect of the cleaning fluid on the fluid conveyance.

17. The apparatus of claim 13, further comprising a heater and a cooler disposed in the body, wherein the heater and the cooler are configured to actively adjust a temperature of the cleaning fluid relative to an ambient temperature in the wellbore.

18. The apparatus of claim 17, wherein the cooler comprises a refrigeration device configured to actively cool the cleaning fluid to a decreased temperature below the ambient temperature in the wellbore, and wherein the heater is configured to actively heat the reservoir fluid to an increased temperature above the ambient temperature in the wellbore.

19. The apparatus of claim 13, comprising one or more valves disposed along the fluid conveyance, wherein the one or more valves are configured to selectively direct the cleaning fluid to a plurality of discrete sections of the cleaning-apparatus and to selectively redirect the cleaning fluid toward an exit of the apparatus.

20. The apparatus of claim 13, comprising a third valve configured to control fluid into the at least one port of the three ports, out of the at least one port of the three ports, and block flow through the at least one port of the three ports.

* * * * *